US007782207B2

(12) United States Patent
Gillard et al.

(10) Patent No.: US 7,782,207 B2
(45) Date of Patent: Aug. 24, 2010

(54) COMPREHENSIVE THEFT SECURITY SYSTEM

(75) Inventors: John Peter Gillard, Cheltenham, PA (US); David Ivins, Berkshire (GB); Nathaniel Cabigao Lacsamana, Bridgewater, NJ (US); Harry Oung, Cherry Hill, NJ (US); Nimesh Shah, Marlton, NJ (US); Bogdan Sima, Sewell, NJ (US)

(73) Assignee: Checkpoint Systems, Inc., Thorofare, NJ (US)

( * ) Notice: Subject to any disclaimer, the term of this patent is extended or adjusted under 35 U.S.C. 154(b) by 308 days.

(21) Appl. No.: 12/133,878

(22) Filed: Jun. 5, 2008

(65) Prior Publication Data

US 2008/0309491 A1 Dec. 18, 2008

Related U.S. Application Data

(60) Provisional application No. 60/943,418, filed on Jun. 12, 2007.

(51) Int. Cl.
*G08B 13/14* (2006.01)

(52) U.S. Cl. ..... 340/572.1; 340/568.1

(58) Field of Classification Search ..... 340/568.1, 340/571, 500–506, 527–531, 573.1, 3.1, 340/825.36, 825.49
See application file for complete search history.

(56) References Cited

U.S. PATENT DOCUMENTS

| | | | | |
|---|---|---|---|---|
| 3,820,102 | A * | 6/1974 | Schubert | 340/506 |
| 4,450,437 | A * | 5/1984 | Ho | 340/540 |
| 5,030,941 | A | 7/1991 | Lizzi et al. | |
| 5,353,011 | A | 10/1994 | Wheeler et al. | |
| 5,600,304 | A | 2/1997 | Accolla et al. | |
| 5,629,667 | A * | 5/1997 | Nyberg | 340/330 |
| 5,699,046 | A | 12/1997 | Accolla et al. | |
| 5,708,423 | A | 1/1998 | Ghaffari et al. | |
| 5,737,241 | A | 4/1998 | Accolla et al. | |
| 5,745,036 | A | 4/1998 | Clare | |
| 5,748,085 | A | 5/1998 | Davis et al. | |
| 5,963,134 | A | 10/1999 | Bowers et al. | |
| 6,195,006 | B1 | 2/2001 | Bowers et al. | |
| 7,046,149 | B1 | 5/2006 | Badenhop et al. | |
| 7,100,052 | B2 | 8/2006 | Ghazarian | |
| 2006/0290506 | A1 | 12/2006 | Badenhop et al. | |
| 2008/0191878 | A1 * | 8/2008 | Abraham | 340/572.1 |

FOREIGN PATENT DOCUMENTS

| | | |
|---|---|---|
| EP | 1596344 | 11/2005 |
| EP | 1619639 | 1/2006 |
| EP | 1632919 | 3/2006 |
| WO | 96/36186 | 11/1996 |

OTHER PUBLICATIONS

International Search Report for corresponding PCT Application No. PCT/US2008/066322, dated Dec. 22, 2008.

* cited by examiner

*Primary Examiner*—Jennifer Mehmood
(74) *Attorney, Agent, or Firm*—Caesar, Rivise, Bernstein, Cohen & Pokotilow, Ltd.

(57) ABSTRACT

An antitheft security system and method using networked pedestals for monitoring, and reporting data relating to, merchandise, having security tags coupled to or embedded therein, leaving or entering a business establishment and alerting business establishment personnel when a theft may be occurring. The system and method collect and communicate security tag data and associated peripheral device data to a remote server for analysis.

27 Claims, 5 Drawing Sheets

42A
Antenna
Antenna
42B
Security Tag
44
Transmitter 1
Transmitter 2
40B
40A
Receiver
Field Programmable Gate Array
24
45
38
36
Digital Signal Processor
34
47A
47B FIG.5A
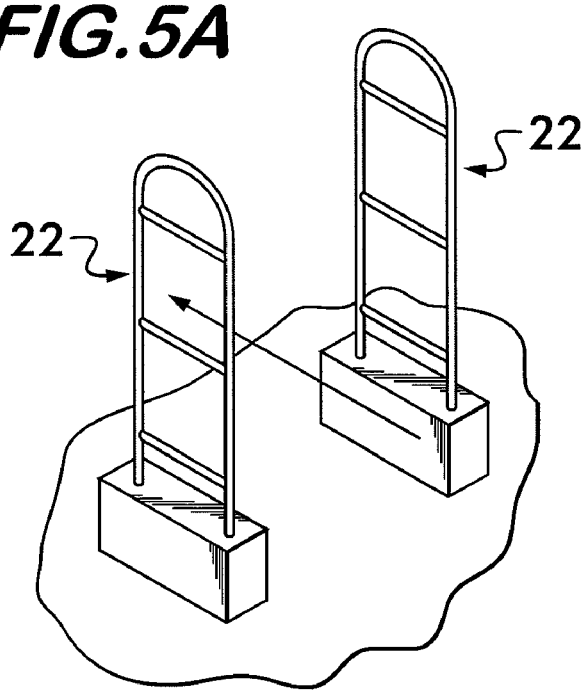
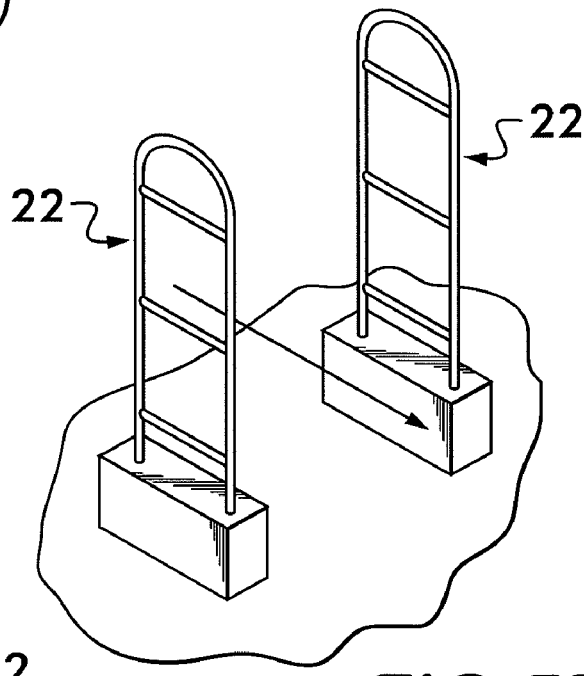
FIG.5B
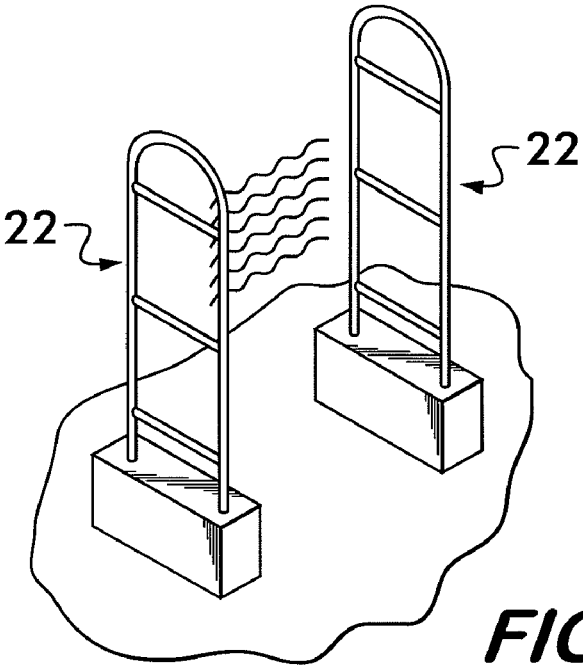
FIG.5C

COMPREHENSIVE THEFT SECURITY SYSTEM

CROSS-REFERENCE TO RELATED APPLICATIONS

This utility application claims the benefit under 35 U.S.C. §119(e) of Provisional Application Ser. No. 60/943,418 filed on Jun. 12, 2007 entitled COMPREHENSIVE THEFT SECURITY SYSTEM and whose entire disclosure is incorporated by reference herein.

BACKGROUND OF THE INVENTION

1. Field of Invention

The current invention relates to a security system for business establishments and, more particularly, a network of electronic article surveillance (EAS) or radio frequency identification (RFID) pedestals that each use a single electronic board for collecting and communicating security tag system sensor data, and associated data, to and from a remote server.

2. Description of Related Art

Electronic article surveillance (EAS) security tags, typically comprise a resonant circuit that utilize at least one coil and at least one capacitor that operate to resonate when exposed to a predetermined electromagnetic field (e.g., 8.2 MHz) to which the EAS tag is exposed. Similarly, radio frequency identification (RFID) tags comprise an integrated circuit coupled to an antenna (e.g., dipole antenna) or a resonant circuit and which operate to emit information when exposed to a predetermined electromagnetic field (e.g., 13.56 MHz). A pedestal with the appropriate hardware is typically provided at the exit of a business (or at the point of sale (POS), as in many European businesses) to provide this tag interrogation and detection operation, as well as alarm function; where a plurality of passageways are used, e.g., in a department store, mall, etc., it is desirous to provide a pedestal for detecting the presence of EAS or RFID security tags at every passageway to detect and warn of the theft of store merchandise.

As thieves become more experienced at trying to defeat such EAS or RFID security tag systems, it has become necessary to assess the performance of these systems, including assessing the performance of personnel (e.g., store personnel, managers, etc.) responsible for these systems. Moreover, business owners also want to be informed about inventory shrinkage (i.e., inventory theft) on a regular basis and to take appropriate precautions to minimize such occurrences.

To achieve such objectives and more, EAS/RFID pedestals have incorporated storing and reporting functions regarding security tag detections including time and date of these occurrences. Where a plurality of pedestals are used, the hardware of these pedestals are linked to a central processor for reporting such occurrences. See for example, U.S. Pat. No. 5,748,085 (Davis, et al.); U.S. Pat. No. 5,745,036 (Clare); and U.S. Pat. No. 5,963,134 (Bowers, et al.). Moreover, the Assignee of the present invention, Checkpoint Systems, Inc., has been marketing such a central processor for collecting security tag data from a plurality of pedestals and markets it under the trademark CHECKPRO MANAGER®. By way of example only, FIG. 1 depicts one such existing EAS systems whereby security tags are detected and related data are collected (at a local location, e.g., a business) and provided to remote management information systems (e.g., headquarters of the business). As can be seen, all EAS antenna data and all related data (e.g., people counter data, reason code generator data, deactivation log data, etc.) are provided to the centralized CPM (CHECKPRO MANAGER®) which then routes such information to remotely-located management information systems.

Other features can be included such as direction detectors whereby the direction in which people are passing through the pedestals can be detected; see U.S. Pat. No. 5,030,941 (Lizzi, et al.). In some cases, the pedestal hardware configuration can be modified remotely from a central station. Furthermore, the tracking of store employee presence, e.g., at the point of sale (POS), or in reacting to security tag alarm, etc., also forms an important part of such security tag systems.

However, existing antitheft security systems are susceptible to problems regarding false alarms, which tend to arise from environmental noise, resonance from the tagged items and undeactivated tags. In addition, many of the existing security tag systems are prone to false alarms, are not easily upgradable and require expensive retrofits, have a limited security tag read distance, are degraded by environmental interference Thus, there remains a need for a comprehensive security tag system that collects the appropriate security tag and related data for use by a remote server in a more effective manner, minimizes false alarms, increases the read distance of security tags, enhances the ability to perform remote diagnostics, provides increased immunity to environmental interference.

All references cited herein are incorporated herein by reference in their entireties.

BRIEF SUMMARY OF THE INVENTION

An antitheft security system for monitoring, and reporting data relating to, merchandise, having security tags coupled to or embedded therein, purchased and leaving a business establishment and alerting business establishment personnel when a theft may be occurring. The security system comprises: a plurality of electronic article surveillance (EAS) or radio frequency identification (RFID) pedestals that automatically monitor respective pedestal zones for the presence of the security tags and for collecting data relating to the presence of the security tags and to associated product data. Each of the pedestals comprises an electronics board comprising: a security tag reader or interrogation electronics which includes a receiver for receiving wireless signals from the security tags and for demodulating the signals over a wide range of frequencies using software-defined radio methodology; communication processor and associated electronics for interfacing with communications media; a storage device for storing the collected data; a plurality of associated devices (e.g., people counter, metal detector (i.e., for detecting booster bags), detachers, deactivators, deactivation logs, reason code generators, alarms/sounders (e.g., annunicators and/or indicators), etc.) coupled to each one of the pedestals for providing security tag presence data and the associated product data to the storage device on the electronics board in each one of the corresponding one of the pedestals; at least one remote server for retrieving the collected data from the storage devices of the plurality of the pedestals via the communications media; and wherein each of the pedestals includes a direction detector for detecting the direction in which a person is passing through the pedestal and a respective alarm, associated with the pedestal, for manifesting the movement of a person through the pedestal, wherein the first alarm indicates movement through the pedestal and out of the business establishment, wherein the second alarm indicates movement through the pedestal into the business establishment and wherein the third alarm indicates stationary position at the pedestal.

A method for monitoring, and reporting data relating to, merchandise, having security tags coupled to or embedded therein, purchased and leaving a business establishment and alerting business establishment personnel when a theft may be occurring. The method comprises: providing a plurality of electronic article surveillance (EAS) or radio frequency identification (RFID) pedestals that automatically monitor respective pedestal zones for the presence of the security tags and for collecting data relating to the presence of the security tags and to associated product data; detecting the direction that a person is moving through the respective pedestal zones and providing respective alarms for movement away from the business establishment, movement into the business establishment or stationary position at a pedestal; coupling a plurality of associated devices (e.g., people counter, metal detector (i.e., for detecting booster bags), detachers, deactivators, deactivation logs, reason code generators, alarms/sounders (e.g., annunicators and/or indicators), etc.) to each one of the pedestals for providing security tag presence data and the associated product data to an electronics board in each one of the corresponding one of the pedestals; linking each of the pedestals in a network; and retrieving, by at least one remote server, the collected data from the plurality of the pedestals via the communications media.

BRIEF DESCRIPTION OF SEVERAL VIEWS OF THE DRAWINGS

The invention will be described in conjunction with the following drawings in which like reference numerals designate like elements and wherein:

FIGS. 5A-5C depict respective motions through the pedestals of the present invention and for which the system of the present invention provides respective alerts.

DETAILED DESCRIPTION OF THE INVENTION

Figure 1:
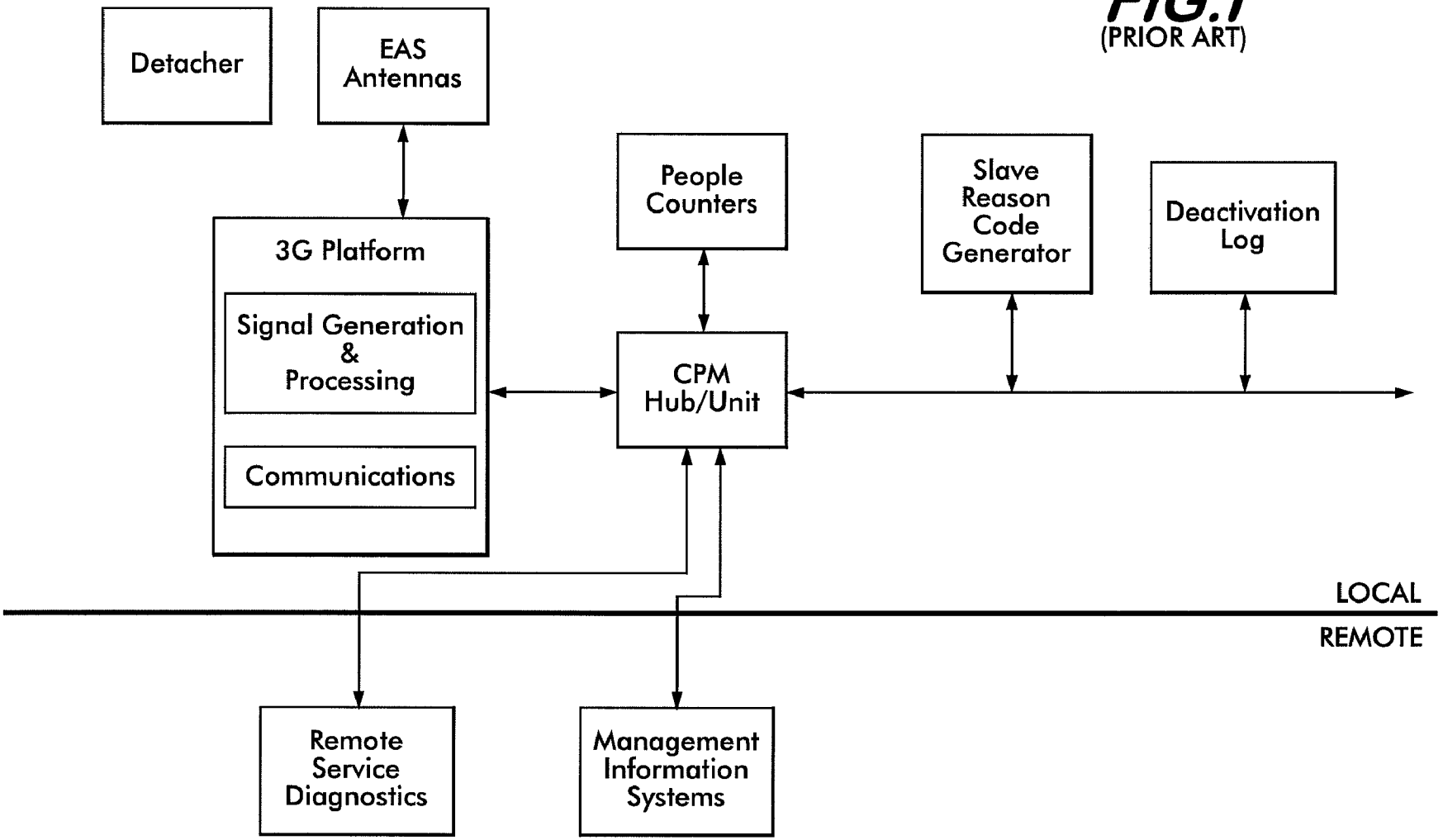
FIG. 1 (PRIOR ART)
FIG. 1 is a block diagram of an existing EAS security system that uses a centralized processor for conveying collected EAS security system data to remote management information systems.
Figure 2:
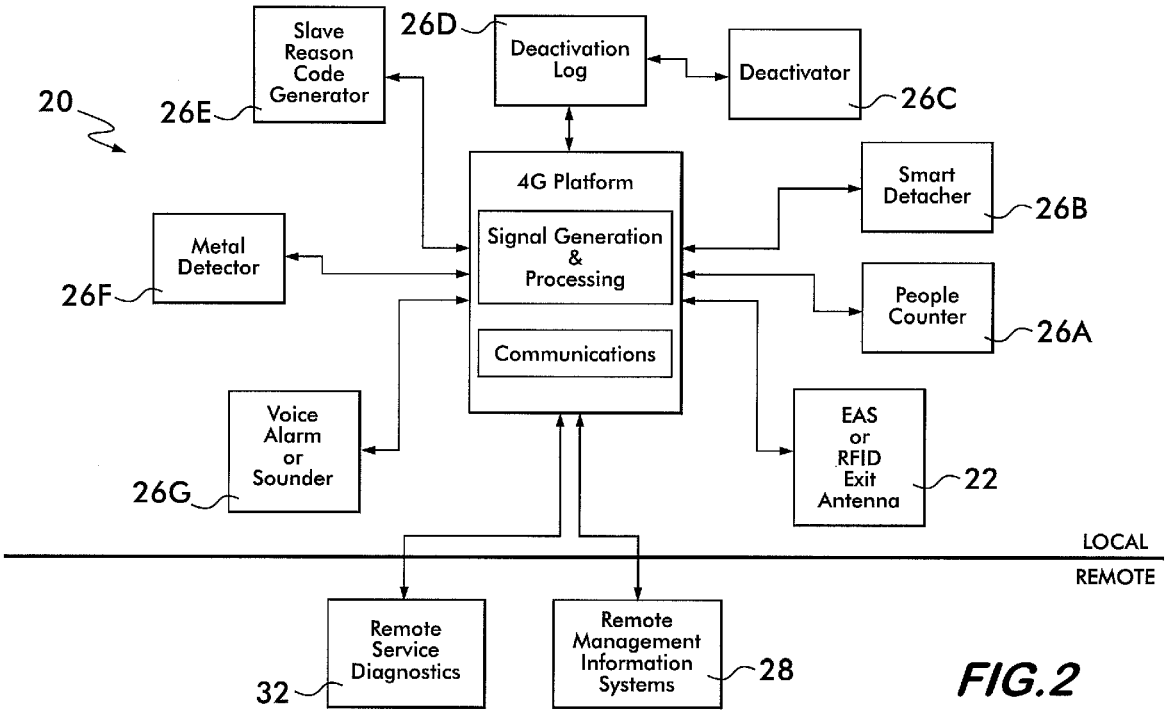
FIG. 2 is a block diagram of the present invention depicting an EAS or RFID exit pedestal and its associated peripherals that communicate with their associated pedestal to provide their respective data thereto for analysis by the remote management information systems.

The present invention comprises a system 20, as shown in FIG. 2, of EAS or RFID pedestals that collect security tag related data during the normal course of business and then make such data available for retrieval by remote servers which analyze the data. One of the important improvements of the present invention 20 over existing EAS security tag and data collection systems is that it is a distributed system whereby data from the various EAS or RFID pedestals 22, and each pedestal's associated devices (e.g., people counters 26A, detachers (including smart detachers) 26B, deactivators 26C, deactivation logs 26D, reason code generators 26E, metal detectors 26F or voice alarms/sounders 26G), can be made available to remote management information systems 28 (e.g., customer servers 28A or other remote servers 28B, see FIG. 3) without the need for a central processor, e.g., CPM hub/unit as shown in FIG. 1. This more efficient system aids in allowing decisions to be made at the time of an event occurrence (e.g., a pedestal event).

The configuration of the system of the present invention provides for, among other things, enhancing system integration with existing security tag systems and new peripherals, greater connectivity options, and enhancing system diagnostics. The present invention achieves these goals by providing tags, antennas, detection electronics, peripherals and host computers.

Figure 3:
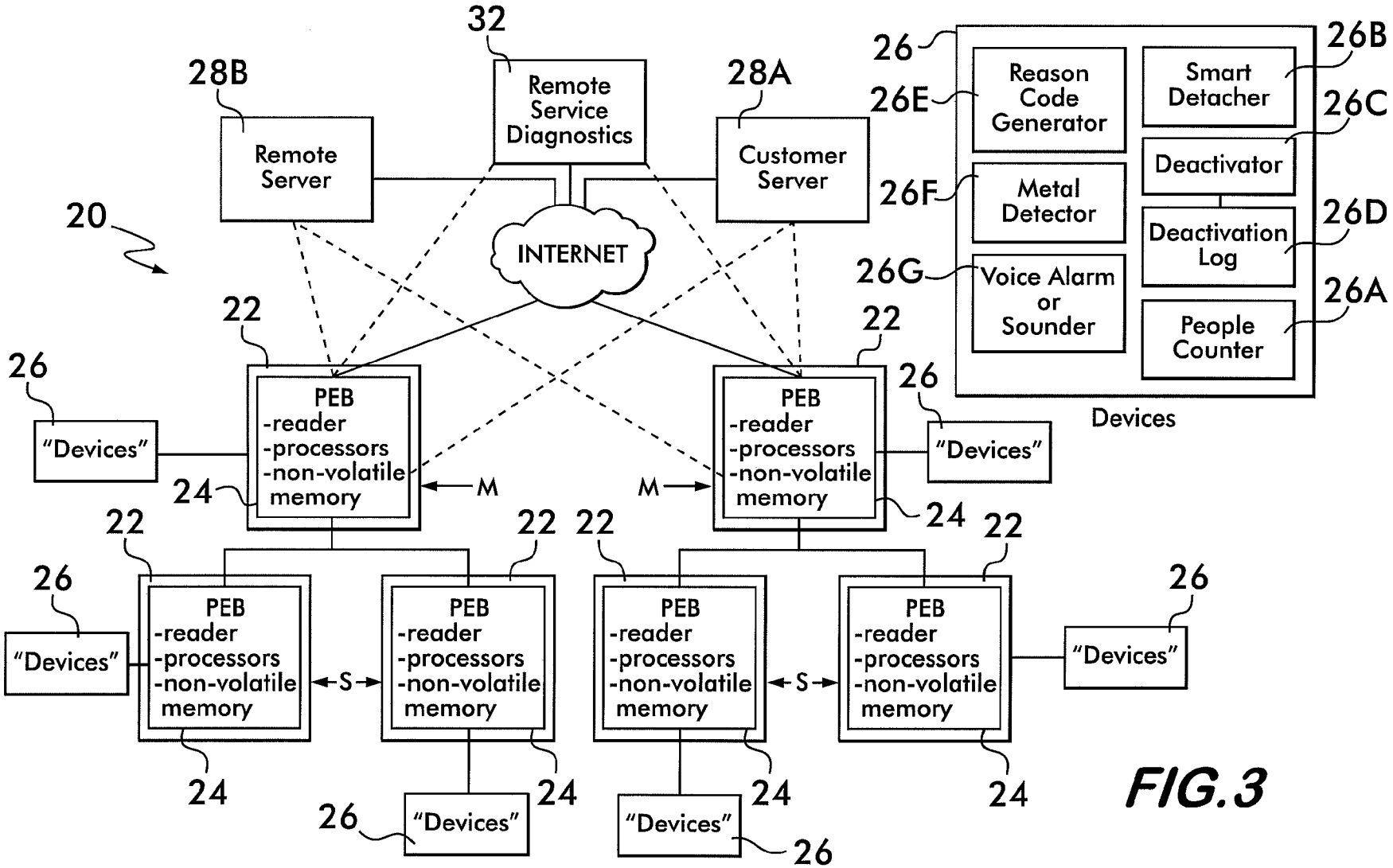
FIG. 3 is a block diagram of the present invention depicting a distributed network system of EAS or RFID pedestals, including their associated devices, that communicate with remote management information systems over the Internet or directly.

In particular, as shown most clearly in FIG. 3, the present invention comprises a system 20 of EAS or RFID exit pedestals that collect security tag related data during the normal course of business and then make such data available for retrieval by remote servers which analyze the data. The configuration of the system 20 of the present invention provides for, among other things, enhancing system integration with existing security tag systems and new peripherals, greater connectivity options, and enhancing system diagnostics while providing better immunity to noise and unwanted resonances. The present invention achieves these goals by providing tags, antennas, detection electronics, peripherals and host computers. To greatly reduce the effect of undesirable alarms, the present invention 20 also includes algorithms including tag discrimination.

In particular, as shown in FIG. 3, each pedestal 22 comprises a pedestal electronics board (PEB) 24 that comprises, among other things, a reader (e.g., an EAS transmitter/receiver, an RFID reader, etc.), processors and non-volatile memory. The reader generates an electromagnetic field in a "pedestal zone" for detecting/communicating with a security tag that is present in the pedestal zone. An array of associated devices 26 (e.g., people counter 26A, detachers 26B or 26C, deactivators/deactivation logs 26D, reason code generators 26E, metal detector 26F (i.e., detectors for detecting "booster bags" which are metal-lined bags into which stolen merchandise can be made invisible to conventional EAS antennas), alarms/sounders 26G (e.g., annunciators and/or indicators), etc.)) are integrated with the PEB detection electronics which provide a major advantage over existing antitheft security systems. These associated devices 26 are in communication with the PEB and provide associated data to the PEB.

Pedestals 22 are arranged to form master-slave configurations, whereby one PEB 24 acts as the master PEB (indicated by the "M" reference) to a plurality of slave PEBs (indicated by the "S" reference). As a result, respective security tag data and associated product data from the slave PEBs are conveyed to the corresponding master PEB. Once a day, the master PEB stores all of the data from these slave PEBs, as well as its own security tag data and associated data, in non-volatile memory.

The present invention 20 uses wire-based and wireless communication. The present invention 20 also provides a direct FTP connection to a customer's database system, thereby permitting easy data integration. By way of example only, these PEBs may be part of an Ethernet connection (the present invention 20 includes both private local network and Ethernet capability native; for connectivity, Ethernet, CAT5, WiFi (b+g), Bluetooth, ZigBee can be used by way of example). Remote servers or host computers 28A or 28B can then retrieve the stored data for analysis via the Internet or through a direct connection to master PEBs. In addition, remote service diagnostics 32 can be implemented for the PEBs 24 using a modem or via a network (e.g., Ethernet) link.

Figure 4:
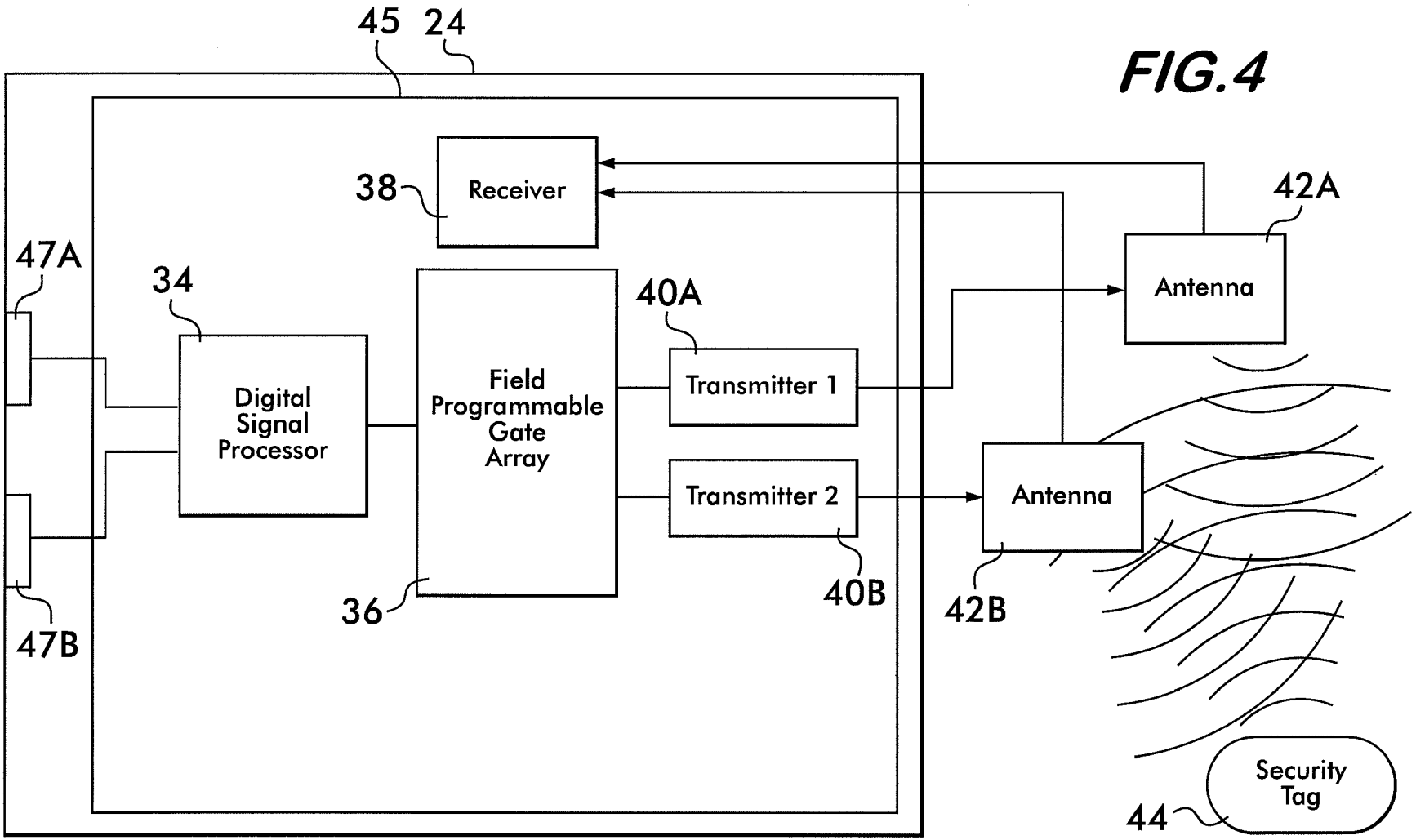
FIG. 4 is a block diagram of an exemplary CPU board of a pedestal electronic board (PEB) used in the present invention.

Each PEB 24 comprises a central processor unit (CPU) board 45 (FIG. 4) and a main board. FIG. 4 is an exemplary hardware diagram of the CPU board 45 used in the present invention 20 (FIG. 3) and which includes a digital signal processor 34 and a field programmable gate array (FPGA) 36, a receiver 38 (e.g., an 8.2 MHz receiver) and two transmitters 40A and 40B which form the security tag reader. As shown in FIG. 4, each transmitter independently drives a corresponding antenna (42A and 42B) for interrogating or initiating communication with a security tag 44 in a pedestal zone created by the electromagnetic field of each transmitter. The security tag 44 emits a response signal which is tuned to the corresponding antenna frequency and then this signal is conveyed to the receiver 38. Where RFID security tags are used, it should be noted that the present invention includes, but is not limited to, 13.56 MHz and UHF (e.g., 902-928 MHz). The FPGA 36 comprises various algorithms for demodulating the response signal in conjunction with the DSP 34. In particular, another aspect of the ease of adaptability of the present invention 20 is to utilize SDR (software defined radio) methodology in the receiver 38. This permits the ability to vary local oscillator portions of any modulator/demodulator operations rather than being tied to a fixed frequency scheme. External communication with the CPU board is achieved through two communication channels 47A/47B.

Security tag detections are time and date stamped into the corresponding PEB memory.

The present invention includes a people counter which is formed by a pair of beams that can detect the direction of movement of a person through the pedestals. Depending on which beam is interrupted before the other one, the direction of the person can be known.

The pedestals incorporate a "smart alarm" operation whereby movement of a detected security tag (using the people counter device) through the pedestals resulting in a corresponding alarm, i.e., movement out of the establishment causes a first alarm, movement into the establishment causes a second alarm and a static position between the pedestals causes a third alarm. For example, as shown in FIG. 5A, movement through the pedestals corresponding to exiting a place of business would most likely indicate a theft of an item. This would activate an alarm sounder to exhibit a "fast" and "hurried" sound, accompanied by "fast" or "hurried" alarm lamps; if a closed circuit television (CCTV, e.g., IP camera) is associated with that location, the CCTV would be activated. If, on the other hand, movement through the pedestals corresponding to entering a place of business (FIG. 5B) would most likely correspond to a patron entering the store with an EAS/RFID label associated with something on, or carried by, that person. This would cause the alarm sounder to be "slow" with short duration alarm lamps. The CCTV may also be activated. Finally, if the tag is detected in between the pedestals with no movement (FIG. 5C) in or out of the store, the alarm sounder would be "short" with a quiet sound and alarm lamps would be short also. The respective CCTV can also be activated. It should also be noted that alarm configurations can also be modified by the customer for a variety of alerts.

It should be noted that where CCTV/IP cameras are used, such data can be provided to the management information servers 28 by a separate server (e.g., CPM, discussed earlier).

The present invention 20 includes displays for supporting electronic advertising.

The conventional method of tag detection has been to use a swept frequency whereby one antenna continuously transmits and a second antenna receives and, as a result, the system must "hear" the tag above the noise of the transmitter. However, the preferred method in the present invention 20 is the pulse listen method whereby a single antenna system is used and the system effectively "asks" if a tag is present and then listens for a response with no transmitter emission.

The present invention 20 includes tag discrimination in different frequency ranges and the center frequency and Q of the detected tags are stored for later retrieval. This also includes distinguishing between hard and soft tags while saving the detected frequency. In particular, Q-qualification is implemented in Emerald using the "correlation coefficient" estimate. The correlation coefficient is a statistical measure that determines if two arrays are correlated:

$$\rho = \frac{\sum (x_i - \bar{x})(y_i - \bar{y})}{\sqrt{\sum (x_i - \bar{x})^2}\sqrt{\sum (y_i - \bar{y})^2}}$$

It takes on value from minus one to plus one, with −1 being negatively related (i.e., inversely proportional), 0 being uncorrelated, and +1 being positively related (or proportional).

In the present invention 20, the correlation coefficient $$r = \frac{\sum x_i y_i}{\sqrt{\sum x_i^2}\sqrt{\sum y_i^2}}$$

is used as a marker to find the best matching between the data samples, x, and a library of ringdown profiles, y. The Q-value of the tag is deduced based on the known Q-value of the particular matching library profile having the highest correlation coefficient among the other library profiles. The result is a "coefficient of matching" index together with the Q-estimate. This allows the detection algorithm to reject the Q-estimate if the computed correlation coefficient is small.

It should be noted that the deactivators differentiate between hard tags and soft tags and do not count the hard tags even though they passed the pad or scanner antennas as deactivations.

It should also be noted that the alarms 26G may include voice alarms (e.g., "Please return to the cashier," or just annunciators that "beep" or "flash" to warn business establishment personnel.

It should be further noted that the pedestals 22 shown in the figures are by way of example and are not limited to those shown. The term "pedestal" are to be broadly construed and my include security tag detectors that can be positioned under floors, in overhead locations, point of sales, etc.

While the invention has been described in detail and with reference to specific examples thereof, it will be apparent to one skilled in the art that various changes and modifications can be made therein without departing from the spirit and scope thereof.

What is claimed is:

1. An antitheft security system for monitoring, and reporting data relating to, merchandise, having security tags coupled to or embedded therein, leaving a business establishment and alerting business establishment personnel when a theft may be occurring, said security system comprising:

a plurality of electronic article surveillance (EAS) or radio frequency identification (RFID) pedestals that automatically monitor respective pedestal zones for the presence of said security tags and for collecting data relating to the presence of said security tags and to associated product data, each of said pedestals comprising an electronics board comprising:

security tag reader or interrogation electronics which includes a receiver for receiving wireless signals from the security tags and for demodulating said signals over a wide range of frequencies using software-defined radio methodology;

communication processor and associated electronics for interfacing with communications media;

storage device for storing said collected data;

a plurality of associated devices coupled to each one of said pedestals for providing security tag presence data and said associated product data to said storage device on said electronics board in each one of said corresponding one of said pedestals;

at least one remote server for retrieving said collected data from said storage devices of said plurality of said pedestals via said communications media; and wherein each of said pedestals includes:

a direction detector for detecting the direction in which a person is passing through said pedestal; and a respective alarm, associated with said pedestal, for manifesting the movement of a person through said pedestals, a first alarm indicating movement through said pedestal and out of the business establishment, a second alarm indicating movement through said pedestal into the business establishment and a third alarm indicating that a movement of said person is of a stationary position at said pedestal.

2. The antitheft security system of claim 1 wherein said direction detector comprises a pair of beams which are interrupted in sequence to establish the direction of movement through said pedestals.

3. The antitheft security system of claim 2 wherein said direction detector is a people counter.

4. The antitheft security system of claim 1 wherein said plurality of EAS or RFID pedestals are arranged into groups of master and slave pedestals, each of said groups comprising a single master pedestal having a plurality of slave pedestals, said slave pedestals transmitting said respective security tag presence data and said associated product data to said master pedestal and wherein said master pedestal provides said respective security tag presence data and said associated product data from said slave pedestals, as well as said master slave's own security tag presence data and said associated product data, for retrieval by said at least one remote server via said communications media.

5. The antitheft security system of claim 1 wherein one said plurality of associated devices is a metal detector.

6. The antitheft security system of claim 1 wherein one of said plurality of associated devices is a deactivator.

7. The antitheft security system of claim 1 wherein one of said plurality of associated devices is a detacher.

8. The antitheft security system of claim 1 wherein one of said plurality of associated devices is a reason code generator.

9. The antitheft security system of claim 1 wherein one of said plurality of associated devices is a deactivation log.

10. The antitheft security system of claim 1 wherein said system detects the Q of the security tag, said system comprising an algorithm that compares response signals to pre-stored tag profiles.

11. The antitheft security system of claim 10 wherein said algorithm comprises:

$$r = \frac{\sum x_i y_i}{\sqrt{\sum x_i^2}\sqrt{\sum y_i^2}}$$

Where, x represents the response signals of said security tag;

y represents said pre-stored tag profiles and r represents a correlation coefficient and wherein the y that produces the largest r value determines the value of Q.

12. The antitheft security system of claim 1 wherein said communication media are global communications networks.

13. The antitheft security system of claim 1 wherein said communication media are telephone lines using modems.

14. The antitheft security system of claim 1 wherein said system further comprises a remote device for effecting service diagnostics for said security system.

15. A method for monitoring, and reporting data relating to, merchandise, having security tags coupled to or embedded therein, leaving a business establishment and alerting business establishment personnel when a theft may be occurring, said method comprising:

providing a plurality of electronic article surveillance (EAS) or radio frequency identification (RFID) pedestals that automatically monitor respective pedestal zones for the presence of said security tags and for collecting data relating to the presence of said security tags and to associated product data said step of collecting data comprises receiving wireless signals from the security tag and demodulating said signals over a wide range of frequencies using software-defined radio methodology;

detecting the direction that a person is moving through said respective pedestal zones and providing respective alarms for movement away from the business establishment, movement into the business establishment and that a movement of said person is of a stationary position at a pedestal;

coupling a plurality of associated devices to each one of said pedestals for providing security tag presence data and said associated product data to an electronics board in each one of said corresponding one of said pedestals;

linking each of said pedestals in a network; and retrieving, by at least one remote server, said collected data from said plurality of said pedestals via said communications media.

16. The method of claim 15 wherein said step of detecting the direction that a patron is moving through said pedestal zones comprises monitoring the sequence of interruption of a pair of beams associated with each of said pedestals.

17. The method of claim 16 wherein said step of detecting the direction that a patron is moving through said pedestal zones further comprises providing a respective alarm for manifesting the movement of a person through or by a pedestal.

18. The method of claim 15 wherein said step of linking of each of said pedestals comprises arranging said plurality of pedestals into groups of master and slave pedestals, wherein each of said groups comprises a single master pedestal having a plurality of slave pedestals, said slave pedestals transmitting said respective security tag presence data and said associated product data to said master pedestal and wherein said master pedestal provides said respective security tag presence data and said associated product data from said slave pedestals, as well as said master slave's own security tag presence data and said associated product data, for retrieval by said at least one remote server via said communications media.

19. The method of claim 15 wherein one said plurality of associated devices is a metal detector.

20. The method of claim 15 wherein one of said plurality of associated devices is a deactivator.

21. The method of claim 15 wherein one of said plurality of associated devices is a detacher.

22. The method of claim 15 wherein one of said plurality of associated devices is a reason code generator.

23. The method of claim 15 wherein one of said plurality of associated devices is a deactivation log.

24. The method of claim 15 wherein said method further comprises the step of detecting the Q of the security tag by comparing response signals from said security tag to pre-stored tag profiles.

25. The method of claim 24 wherein said step of detecting the Q comprises using a relationship:

$$r = \frac{\sum x_i y_i}{\sqrt{\sum x_i^2}\sqrt{\sum y_i^2}}$$

Where, x represents the response signals of said security tag;

y represents said pre-stored tag profiles and r represents a correlation coefficient and wherein the y that produces the largest r value determines the value of Q.

26. The method of claim 15 wherein said communication media are global communications networks.

27. The method of claim 15 wherein said communication media are telephone lines using modems.

* * * * *